US005984550A

United States Patent [19]

Chuang

[11] Patent Number: 5,984,550

[45] Date of Patent: Nov. 16, 1999

[54] WRITING DEVICE

[75] Inventor: Cheng-Hwa Chuang, Taipei, Taiwan

[73] Assignee: Pioneer Industrial Corp., Taipei, Taiwan

[21] Appl. No.: 08/606,598

[22] Filed: Feb. 26, 1996

[30] Foreign Application Priority Data

Dec. 13, 1995 [JP] Japan ..... 7-324829

[51] Int. Cl.[6] ..... B43K 23/10; B43K 27/04

[52] U.S. Cl. ..... 401/57; 401/202; 401/243

[58] Field of Search ..... 401/57, 202, 243

[56] References Cited

U.S. PATENT DOCUMENTS

| | | | |
|---|---|---|---|
| 1,737,798 | 12/1929 | Kinzinger | 401/57 |
| 3,898,009 | 8/1975 | Christensen | 401/57 |
| 5,221,152 | 6/1993 | Chuang . | |

FOREIGN PATENT DOCUMENTS

| | | | |
|---|---|---|---|
| 22077 | 9/1910 | United Kingdom | 401/243 |
| 2218381 | 11/1989 | United Kingdom | 401/243 |
| 2246979 | 2/1992 | United Kingdom | 401/57 |

*Primary Examiner*—Steven A. Bratlie
*Attorney, Agent, or Firm*—Ladas & Parry

[57] ABSTRACT

In a writing device, an engaging portion having an annular protrusion and an annular depression is formed on the outer surface of the head end portion of a writing device body. Also, an engaging portion having an annular protrusion and an annular depression is formed on the outer surface of the tail end portion of the writing device body. A plurality of engaging protrusions are formed on the inner surface of a cap arranged at a predetermined spacing in the circumferential direction of the cap. When the cap is attached to the writing device body, the engaging protrusions move over the head end side annular protrusion and then engage with the head end side annular depression. When the cap is attached to the tail end of the writing device body, the engaging protrusions of the cap move over the tail end side annular protrusion and then engage with the tail end side annular depression. As a result of the engagement, the cap is less likely to unintentionally come off the writing device body. Also, a click occurs upon engagement, whereby the user can make sure that the cap has properly engaged with the writing device body.

6 Claims, 5 Drawing Sheets

WRITING DEVICE

BACKGROUND OF THE INVENTION

1. Field of the Invention

The present invention relates to writing devices such as refillable pencils, ballpoint pens and the like having a writing device body and a cap which removably fits to an outer surface of a head end portion and the tail end portion of the writing device body.

2. Description of the Related Art

A conventional writing device having a writing device body and a cap is described in U.S. Pat. No. 5,221,152.

The writing device is a refillable pencil or the like having a writing device body and a cap. The writing device body comprises three members, namely an axial pipe or tube, a head end portion, and a tail plug. The head end portion is coupled with the head end of the axial pipe while the tail plug is coupled with the tail end of the axial pipe. A core member is mostly housed in the writing device and has a head end writing portion projecting from the head end of the writing device body. The cap has a cap body and a cover fitted to the head end portion of the cap body.

In conventional writing devices cap, is removably fitted to a cap fitting portion formed on the outer surface of the writing device body. Thus, in the case of a refillable pencil, when a user carries it with her/him, the cap may come off the writing device body due to vibration or the like with a potential breakage of a pencil lead, damage to an article, or injury to a user by the pointed end of the pencil lead which projects from the writing device body. In the case of a ballpoint pen, a ball projecting from the writing device body may smudge an article or cause similar damage.

In the case of a writing device like a fountain pen, external threads are formed on the outer surface of the writing device body and internal threads are formed on the inner surface of the cap, whereby the cap is attached to the writing device body by engaging the external and internal threads. This type of writing device makes removal and reattachment of the cap troublesome due to the required turning the cap for its removal and reattachment. Further, when the user carries it with her/him, the cap may loosen or come off due to vibration.

SUMMARY OF THE INVENTION

The present invention has been made in view of the above-mentioned facts. An object of the present invention is to provide a writing device, such as a refillable pencil, ballpoint pen or the like, wherein the cap is easily fitted to the writing device body, but is less likely to come off the writing device body and which notifies the user of the secure engagement of the cap and the writing device body.

Another object of the present invention is to provide a writing device which uses a smaller number of parts and provides an attractive appearance.

The writing device according to the present invention has a writing device body, a core member which is mostly housed in the writing device body and which has a head end writing portion projecting from the head end of the writing device body, and a cap which is removably fitted to the outer surface of the writing device body so as to cover the head end portion of the writing device body and the head end writing portion of the core member. An engaging portion is formed on the outer surface of each of the head end portion and the tail end portion of the writing device body. The engaging portion comprises an annular protrusion and an annular depression which merges into the annular protrusion and which is located on the side of the central portion of the writing device body. A plurality of engaging protrusions are formed on the inner surface of the cap arranged at a predetermined spacing in a circumferential direction. The engaging protrusions engage with the annular depression when the cap is attached to the writing device body.

When the cap is fitted to the outer surface of the head end portion or the tail end portion of the writing device body, the plurality of engaging protrusions formed on the inner surface of the cap move over the annular protrusion of the engaging portion of the writing device body. As a result, the cap deforms elastically and expands partially in diameter. Then, when the engaging protrusions engage with the annular depression of the engaging portion, the elastically deformed cap is restored to a certain extent with an occurrence of a click. This click notifies the user that the engaging protrusions have properly engaged with the annular depression.

When the cap attached by the engagement of the engaging protrusions with the annular depression is removed from the writing device body, the engaging protrusions of the cap move over the annular protrusion of the engaging portion of the writing device body. As a result, the cap deforms elastically and a resistance occurs. This prevents the cap from unintentionally coming off the writing device body and consequently lessens a potential breakage of a pencil lead of a refillable pencil, damage to an article or injury to a user by the point of the pencil lead. In the case of a ballpoint pen, smudge on an article by ink from the ink ball is prevented.

Preferably, the writing device body has an axial tube or pipe and a tail plug fitted to the tail end portion of the axial pipe, the axial pipe is transparent or semitransparent, the outer surface of the axial pipe has a circular cross-section over the entire length in the axial direction thereof, and the inner surface of at least an axially intermediate portion of the axial pipe is formed into a polygonal portion having a cross-sectional shape of a regular hexagon or the like.

In the writing device, the writing device body comprises two members, namely the axial pipe and the tail plug fitted to a tail end portion thereof. Thus, as compared with the conventional writing device body which comprises three members, namely a head end portion, an axial pipe and a tail plug, the number of parts can be decreased. This simplifies the structure of the writing device and facilitates assembly of the writing device.

The axial pipe is transparent or semitransparent, the outer surface of the axial pipe has a circular cross-section over the entire length in the axial direction thereof, and the inner surface of at least an axially intermediate portion of the axial pipe is formed into a polygonal portion having a cross-sectional shape of a polygon, thereby providing a lens function. This lens function provides an attractive appearance because of optical reflection.

Preferably, the cap has a transparent or semitransparent cap body and an end cover fitted to the head end portion of the cap body, and at least one of either the tail plug or the end cover is opaquely colored.

In this case, the cap has a transparent or semitransparent cap body and an end cover fitted to the head end portion of the cap body, and at least one of either the tail plug or the end cover is opaquely colored. This provides an attractive color effect and thus improves appearance.

Preferably, the cap has a cap body and an end cover fitted to a projecting cylinder provided at the head end portion of the cap body, and a ventilation hole is formed in the end cover such that the ventilation hole penetrates the end cover at the central portion thereof in the axial direction thereof.

In this case, the end cover is fitted to the projecting cylinder provided at the head end portion of the cap body, and a ventilation hole is formed in the end cover such that the ventilation hole penerates the end cover at the central portion thereof in the axial direction thereof. Accordingly, even when an infant or the like accidentally swallows the end cover into his/her trachea or gullet, the end cover is readily taken out of his/her body using the ventilation hole, and the end cover lodged in the trachea can be prevented from choking the infant.

The writing device may be a refillable pencil. In the refillable pencil, the writing device body has an axial pipe and a tail plug fitted to the tail end portion of the axial pipe. The tail plug is an elastic formed article of plastic. The cylindrical portion of the tail plug has a larger-outside diameter flange integrally formed at the tail end thereof and a tapered cylindrical body integrally formed at the head end thereof. A plurality of axially extending slits are provided in the tapered cylindrical body such that the slits reach the head end surface thereof. The tapered cylindrical body and the cylindrical portion are fitted into the axial pipe thereby to have the flange butt against the tail end of the axial pipe. A core member comprises a number of writing cartridges, each having a holding cylinder. The base portion of a pencil lead is securely fitted into a smaller-diameter portion of the holding cylinder, which projects from the head end portion of the larger-diameter portion of the holding cylinder. The smaller-diameter portion of the holding cylinder of a writing cartridge and the tip of the pencil lead projecting from the smaller-diameter portion are loosely inserted into the larger-diameter portion of the holding cylinder of the adjacently preceding writing cartridge of the core member. Most of a large number of the writing cartridges are fitted to one another and loaded in the axial pipe in a manner allowing axial movement. The larger-diameter portion of the holding cylinder of the head endmost writing cartridge is removably held in the head end portion of the axial pipe. The larger-diameter portion of the holding cylinder of the tail endmost writing cartridge is fitted and held in the tail plug, while the tail end of the larger-diameter portion of the holding cylinder of the second tail endmost writing cartridge butts against the head end of the tail plug.

In this case, the tail plug is an elastic formed article of plastic. The cylindrical portion of the tail plug with a larger-outside diameter flange has a tapered cylindrical body integrally formed at the head end thereof. A plurality of axially extending slits are provided in the tapered cylindrical body such that the slits reach the head end surface thereof. The tapered cylindrical body and the cylindrical portion are fitted into the axial pipe thereby to have the flange butt against the tail end of the axial pipe. A core member comprises a number of writing cartridges, each having a holding cylinder. The base portion of a pencil lead is securely fitted into a smaller-diameter portion of the holding cylinder, which projects from the head end portion of the larger-diameter portion of the holding cylinder. The larger-diameter portion of the holding cylinder of the tail endmost writing cartridge is fitted and held in the tail plug, and the tail end of the larger-diameter portion of the holding cylinder of the second tail endmost writing cartridge butts against the head end of the tail plug. This feature provides the following effect.

During writing on paper or the like using the pencil lead of the head endmost writing cartridge whose pencil lead and part of the holding cylinder project from the writing device body, a writing force associated with the pencil lead is sequentially transmitted from the head endmost writing cartridge to the subsequent writing cartridges on the tail end side through their holding cylinders. The holding cylinder of the second tail endmost cartridge is received at the head end of the tapered cylindrical body of the tail plug. As a result, a force is applied to the tapered cylindrical body so as to expand it outward, whereby the head end portion of the tapered cylindrical body is pressed against the inner surface of the tail end portion of the axial pipe. Accordingly, the tail plug is held in the axial pipe without displacement toward the tail end side. That is, the head endmost cartridge does not retreat toward the tail end side due to the writing force associated therewith, whereby providing stable writing performance.

Alternatively, the writing device can be a ballpoint pen. In the ballpoint pen, a writing device body has an axial pipe and a tail plug fitted to the tail end portion of the axial pipe. A core member comprises a ballpoint pen core in which the base portion of a metallic cylinder provided with a ball at the head end portion thereof is securely fitted into the head end portion of a tube containing ink. The head end of the tube is supported by the tail end of the small-bore portion located at the head end portion of the axial pipe thereby to project the head end portion of the metallic cylinder from the head end of the axial pipe. Most of the core member is housed in the axial pipe in the axial direction thereof and the tail end of the tube is supported by the tail end portion in the tail plug. The outer surface of the head end portion of the tube is supported by a plurality of protrusions jutting from the inner surface of the head end portion of the axial pipe, and the outer surface of the tail end portion of the tube is supported by a plurality of protrusions jutting from the inner surface of the tail plug.

In this case, the tube do not make displacement in directions intersecting the axial direction of the writing device body or move in the axial direction. Thus, in spite of the simple structure of the ballpoint pen core and the writing device body, the writing device provides stable writing performance when writing with the ballpoint pen core.

DETAILED DESCRIPTION OF THE PREFERRED EMBODIMENTS

Embodiments of the present invention will now be described with reference to the drawings.

A writing device according to a first embodiment of the present invention is depletedin in FIGS. 1 through 9. As shown in FIGS. 1 to 5, a writing device body 1 comprises an axial tube or pipe 2 of transparent or colored transparent plastic and an elastic transparent plastic tail plug 3.

The axial pipe 2 has a circular cross-section. A head end portion 2*a*, a engaging portion 2*b*, a holding portion 2*c*, a smooth portion 2*d*, a engaging portion 2*e*, and a tail end portion 2*f* are formed on the outer surface of the axial pipe 2. The head end portion 2*a* is tapered. The engaging portion 2*b* is formed on the side of the tail end of the head end portion 2*a* and comprises an annular protrusion 2*b*1 and an annular depression 2*b*2, the annular depression 2*b*2 being located on the side of the central portion of the axial pipe 2 with respect to the annular protrusion 2*b*1. The holding portion 2*c* is formed on the side of the tail end of the engaging portion 2*b* and comprises a number of indentations and protrusions which are alternately arranged in the axial direction of the axial pipe 2. The smooth portion 2*d* is formed axially elongated. The engaging portion 2*e* is formed on the side of the tail end of the smooth portion 2*d* and comprises an annular depression 2*e*2 and an annular protrusion 2*e*1, the annular depression 2*e*2 being located on the side of the central portion of the axial pipe 2 with respect to the annular protrusion 2*e*1. The tail end portion 2*f* slightly bulges at the side of the tail end of the engaging portion 2*e* and then is tapered.

Figure 5:
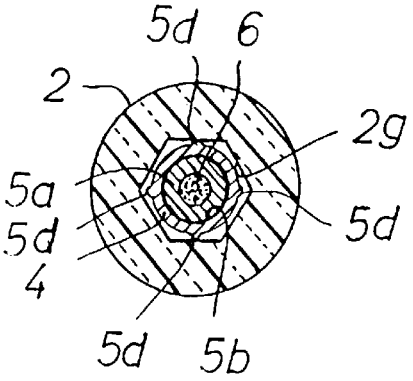
FIG. 5 is an enlarged cross-section along the line B—B of FIG. 1.

A polygonal portion 2*g*, a small-bore portion 2*h*, and a large-bore portion 2*i* are formed on the inner surface of the axial pipe 2. The polygonal portion 2*g* is formed at the axially intermediate portion of the axial pipe 2 and has a cross-sectional shape of a regular hexagon, for example as can be seen in FIG. 5. The small-bore portion 2*h* having a circular cross-section is formed on the side of the head end of the polygonal portion 2*g*. The large-bore portion 2*i* is formed on the side of the tail end of the polygonal portion 2*g*. The small-bore portion 2*h* extending to the engaging portion 2*b* of the axial pipe 2 or to the adjacency thereof has a circular cross-section and smoothly merges into the polygonal portion 2*g*. The head end of the large-bore portion 2*i* is located slightly ahead of the annular depression 2*e*2 and inscribed in the polygonal portion 2*g*, and the tail end thereof extends to the tail end of the axial pipe 2.

Figure 1:
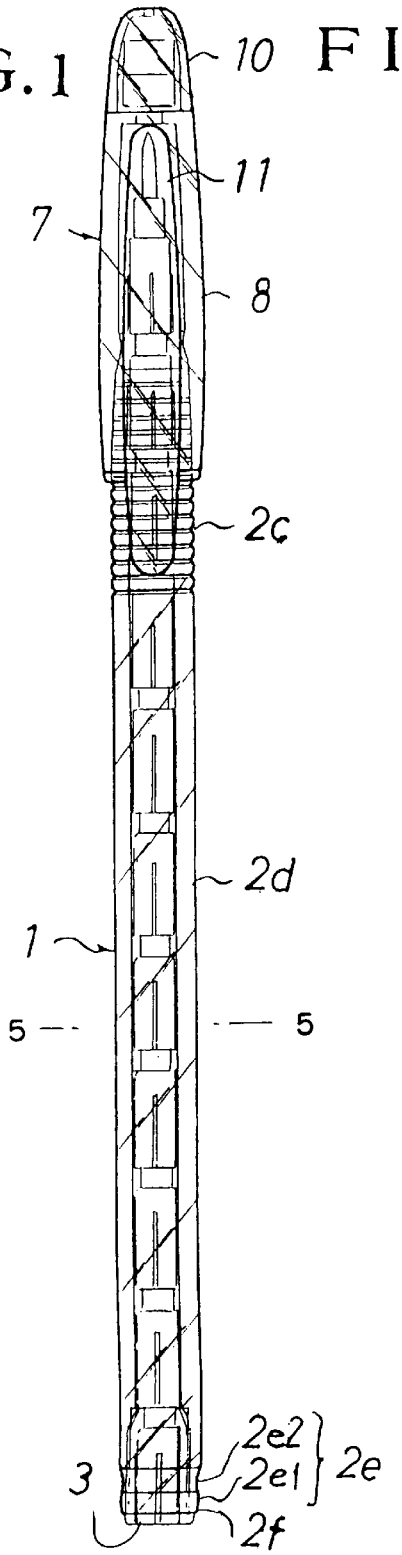
FIG. 1 is a front view showing a writing device according to a first embodiment of the present invention.
Figure 2:
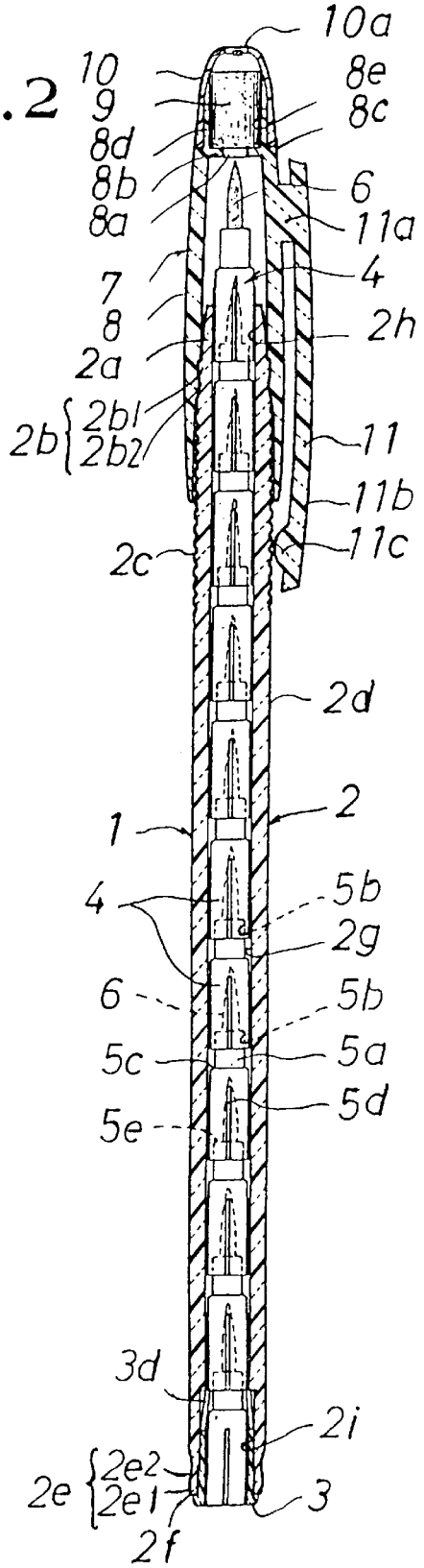
FIG. 2 is a longitudinal section of the writing device of FIG. 1.
Figure 3:
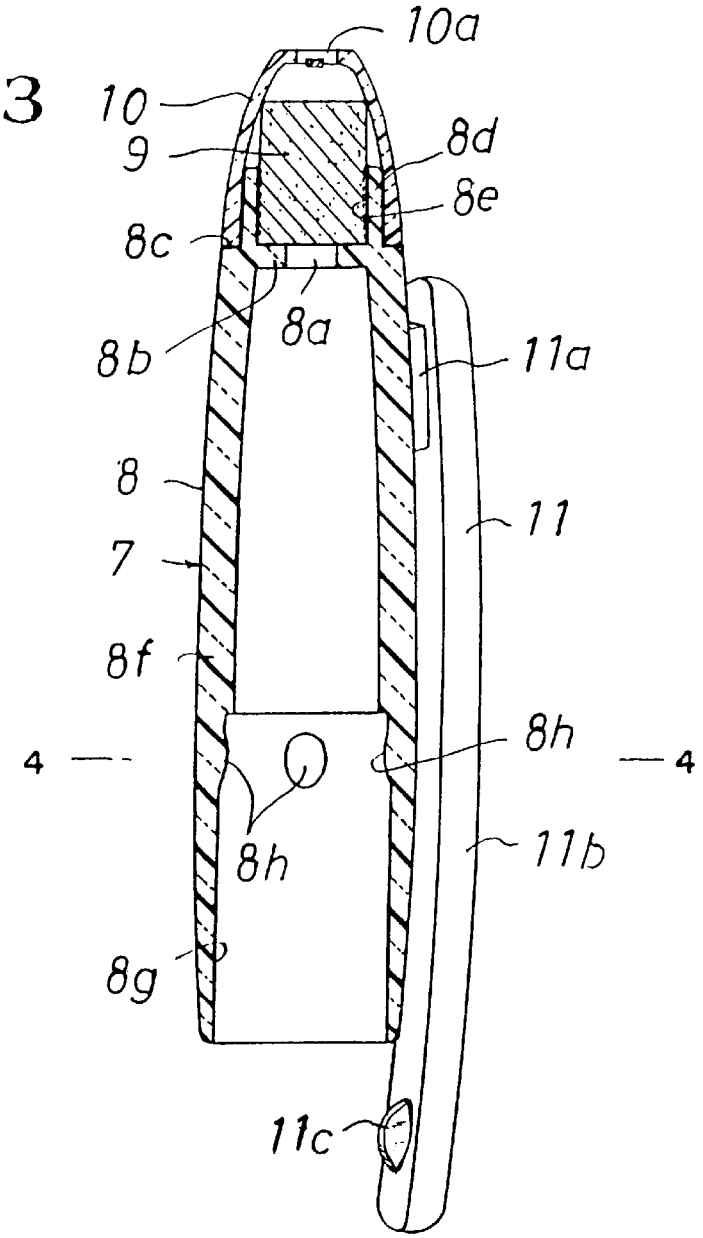
FIG. 3 is an enlarged longitudinal section of the cap of the writing device of FIG. 1.
Figure 4:
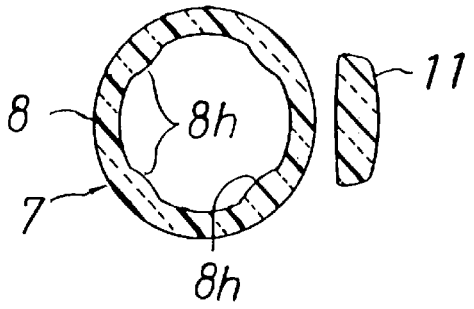
FIG. 4 is an enlarged cross-section along the line A—A of FIG. 3.
Figure 6:
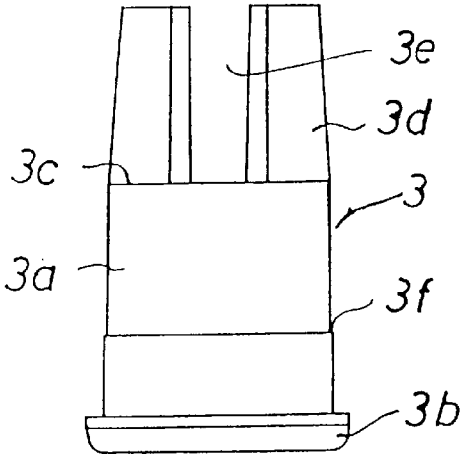
FIG. 6 is an enlarged front view showing the tail plug of the writing device according to the first embodiment.
Figure 7:
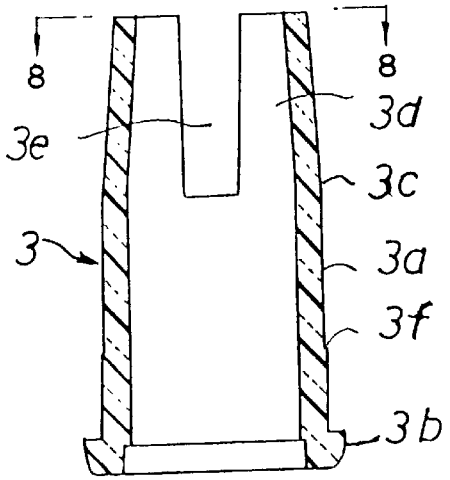
FIG. 7 is a longitudinal section of the tail plug of FIG. 6.
Figure 8:
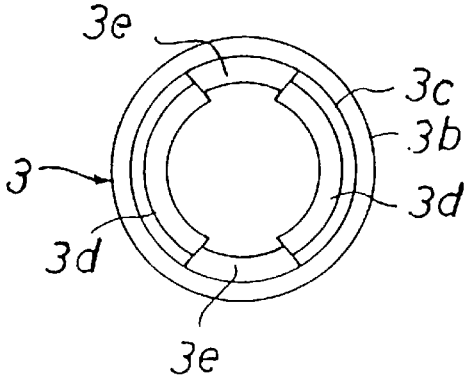
FIG. 8 is a view from the line C—C of FIG. 6 showing the tail plug.

As shown in FIGS. 6 to 8, in the tail plug 3, an annular flange 3*b* projects radially outward from the tail end portion of a cylindrical portion 3*a*. A tapered cylindrical body 3*d* extendeds from the head end of the cylindrical portion 3*a*, and its outside diameter is slightly reduced through a shoulder 3*c*. A pair of slits 3*e* are formed opposed to one another in the tapered cylindrical body 3*d* such that they reach the head end surface of the tapered cylindrical body 3*d* and that they extend to the shoulder 3*c* in the axial direction. A shoulder 3*f* providing a small step is formed on the cylindrical portion 3*a* near the flange 3*b* so that the portion of the cylindrical portion 3*a* extending from the shoulder 3*f* toward the head end has a smaller outside diameter.

The cylindrical portion 3*a* of the tail plug 3 is press-fitted into the large-bore portion 2*i* of the axial pipe 2 and held therein, and the flange 3*b* is brought in contact with the tail end of the axial pipe 2, thereby forming the writing device body 1. The head end of the tapered cylindrical body 3*d* of the tail plug 3 is located at the head end portion of the large-bore portion 2*i*, and the outer surface of the flange 3*b* of the tail plug 3 is adapted not to project beyond the outer surface of the tapered tail end portion 2*f* of the axial pipe 2. The cylindrical portion 3*a* of the tail plug 3 may not have the slight shoulder 3*f* so that it has the same outside diameter over the entire length thereof.

As shown in FIGS. 1 to 4, in writing cartridges 4 which have a core member, a holding cylinder 5 is formed of plastic and opaquely colored in white or the like. The base portion of a pencil lead 6 is inserted into the smaller-diameter portion 5*a* of the holding cylinder 5 and fixed therein. The tip of the pencil lead 6 projects from the head end of the smaller-diameter portion 5*a*. A larger-diameter portion 5*b* is integrated with the smaller-diameter portion 5*a* via an external shoulder 5*c*. A plurality of, for example, four small protrusions 5*d* are formed on the outer surface of the larger-diameter portion 5*b* in the axial direction equally spaced in the circumferential direction.

Several to ten-odd writing cartridges 4 with their pencil leads 6 oriented toward the head end of the axial pipe 2 are inserted into the axial pipe 2 from outside the tail end of the tail plug 3 provided at the tail end portion of the axial pipe 2. The projecting portion of the pencil lead 6 of a particular writing cartridge 4 (hereinafter referred to as the following writing cartridge 4) is loosely inserted into the larger-diameter portion 5*b* of the holding cylinder 5 of the preceding writing cartridge 4. The head end of the smaller-diameter portion 5*a* of the holding cylinder 5 of the following writing cartridge 4 is brought in contact with an internal shoulder 5*e* between the smaller-diameter portion 5*a* and the larger-diameter portion 5*b* of the holding cylinder 5 of the preceding writing cartridge 4. The larger-diameter portion 5*b* of the holding cylinder 5 of the head endmost writing cartridge 4 is removably and elastically held in the small-bore portion 2*h* formed at the head end portion of the axial pipe 2. The larger-diameter portion 5*b* of the holding cylinder 5 of the tail endmost writing cartridge 4 is fitted and held in the tail plug 3.

In the state described above, in the holding cylinder 5 of the head endmost writing cartridge 4, the larger-diameter portion 5*b* is held in the small-bore portion 2*h* at the head end portion of the axial pipe 2 with a small holding force. The holding cylinders 5 of the intermediate writing cartridges 4 are fitted slidably in the axial direction in the polygonal portion 2*g* of the axial pipe 2. In the holding cylinder 5 of the tail endmost writing cartridge 4, the tail end portion of the larger-diameter portion 5*b* is held in the cylindrical portion 3*a* of the tail plug 3, and the head end portion of the larger-diameter portion 5*b* is elastically held in the tapered cylindrical body 3*d* of the tail plug 3 by expanding the tapered cylindrical body 3*d* outward. Therefore, the larger-diameter portion 5*b* can be held by the tail plug 3 with a large holding force. The tail end surface of the larger-diameter portion 5*b* is flush with the tail end surface of the tail plug 3. The tail end of the larger-diameter portion 5*b* of the holding cylinder 5 of the second tail endmost cartridge 4 is adapted to abut on the head end of the tapered cylindrical body 3*d* of the tail plug 3.

The cap 7, as shown in FIGS. 1 to 4, has a cap body 8, an eraser 9, and an end cover 10. The cap body 8 is elastic and transparent and formed of plastic. The end cover 10 is transparent and formed of plastic. The eraser 9 is opaquely colored.

In the cap body 8, a supporting plate 8*b* having a center hole 8*a* is formed along the inner circumference of the head end portion of the cap body 8. A projecting cylinder 8*d* is formed on the head end side of the supporting plate 8*b*, and its diameter is reduced via a shoulder 8*c*. A plurality of, for example, four, small axially extending protrusions 8*e* are formed on the inner surface of the projecting cylinder 8*d* equally spaced in the circumferential direction.

The columnar eraser 9 is press-fitted into the projecting cylinder 8*d* from outside the open end thereof. The base portion of the eraser 9 is held in the projecting cylinder 8*d*. The outer surface of the base portion of the eraser 9 engages the small protrusions 8*e*, thereby preventing the eraser 9 from rotating about the axis of the cap body 8 and from coming off in the axial direction. The end cover 10 is removably fitted to the outer surface of the projecting cylinder 8*d* so as to cover the portion of the eraser 9 projecting from the projecting cylinder 8*d*. A ventilation hole 10*a* is formed in the end cover such that the hole 10*a* axially penetrates the central portion of the head end of the end cover 10. The open tail end of the end cover 10 abuts the shoulder 8*c* of the cap body 8.

A large-bore portion 8*g* is formed at the open end portion of a covering cylinder 8*f* which projects opposite to the projecting cylinder 8. The thickness of the large-bore portion 8*g* is gradually reduced toward the open end portion thereof. A plurality of, for example, four, engaging protrusions 8*h* project from the inner surface of the large-bore portion 8*g* equally spaced in the circumferential direction. The engaging protrusions 8*h* have a cross-section which is oblong or circular in the axial direction of the large-bore portion 8*g* and project radially inward in a spherical arc. The engaging protrusions 8*h* disengageably engage with the annular depression 2*b*2 in the engaging portion 2*b* provided at the head end portion 2*a* of the axial pipe 2 of the writing device body 1 due to a partial elastic deformation of the covering cylinder 8*f*. The covering cylinder 8*f* covers the portion of the head endmost writing cartridge 4 projecting from the axial pipe 2 and the portion of the axial pipe 2 extending from the mid portion of the holding portion 2*c* to the head end of the axial pipe 2.

A coupling portion 11*a* for a clip 11 projects from the outer surface of the head end portion of the cap body 8. The base portion of a clip bar 11*b* is integrally coupled with the projecting end of the coupling portion 11*a*. The clip bar 11*b* extends toward the open end of the cap body 8 leaving a clearance between the clip bar 11*b* and the outer surface of the cap body 8. A plate protrusion 11*c* projects from the inner surface of the head end portion of the clip bar 11*b* projecting beyond the open end of the cap body 8. The protrusion 11*c* has an arcuate contact surface. When the cap body 8 is fitted to the axial pipe 2, the protrusion 11*c* faces the holding portion 2*c* leaving an appropriate clearance therebetween.

The use of the aforesaid writing device comprising refills according to the first embodiment will now be described.

Figure 9:
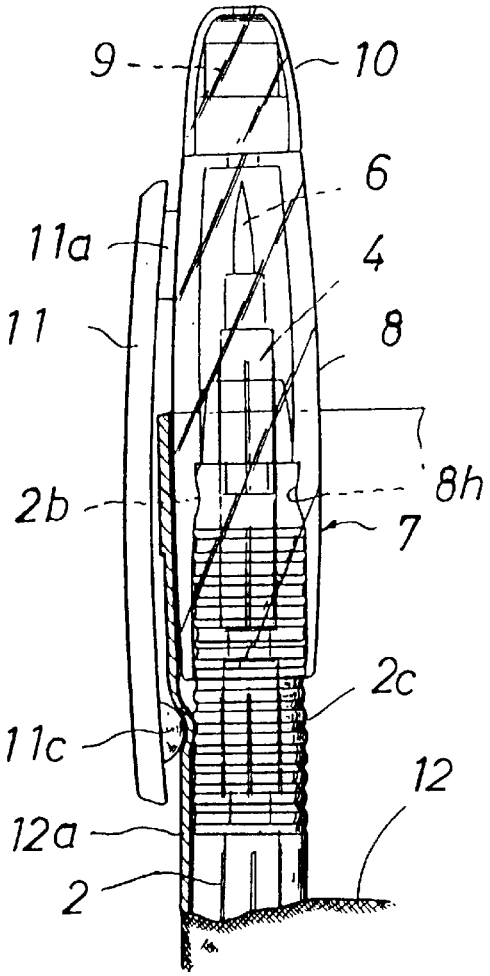
FIG. 9 is an enlarged partial view showing the state of carrying the writing device according to the first embodiment.
Figure 10:
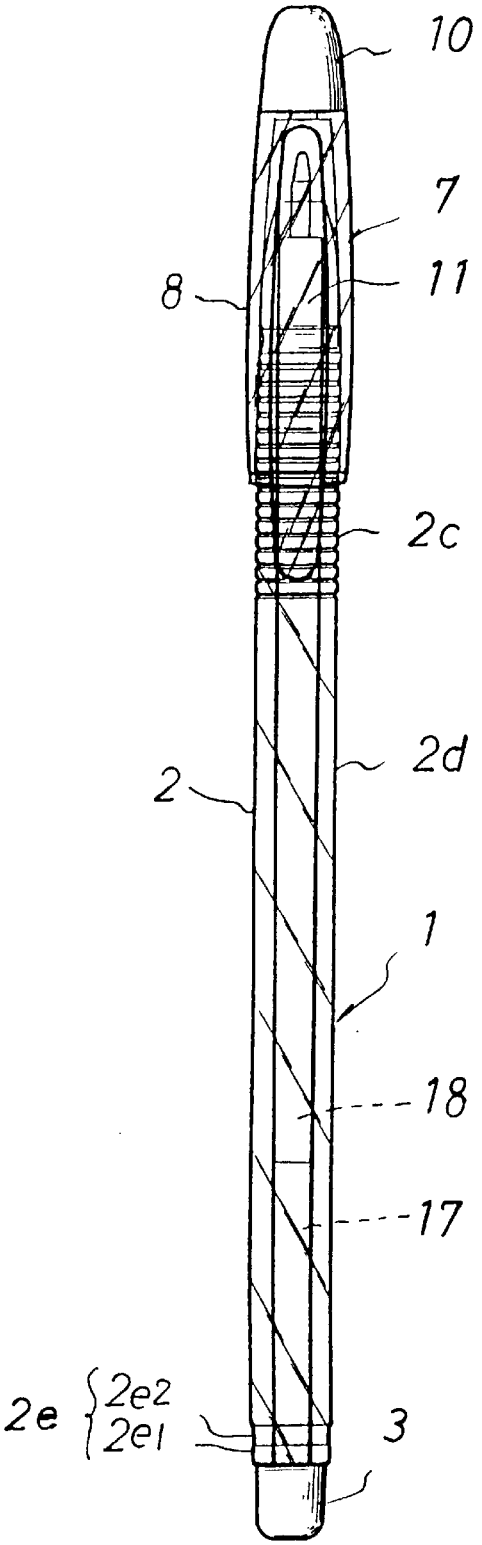
FIG. 10 is a front view showing a writing device according to a second embodiment of the invention.
Figure 11:
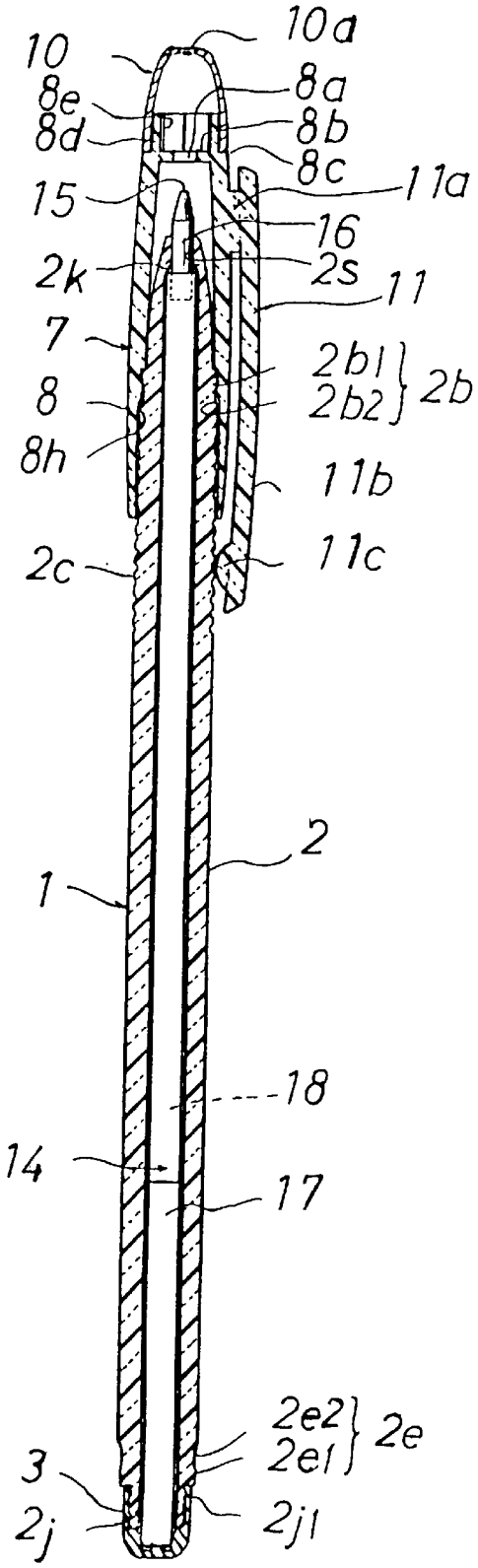
FIG. 11 is a longitudinal section of the writing device of FIG. 10.
Figure 12:
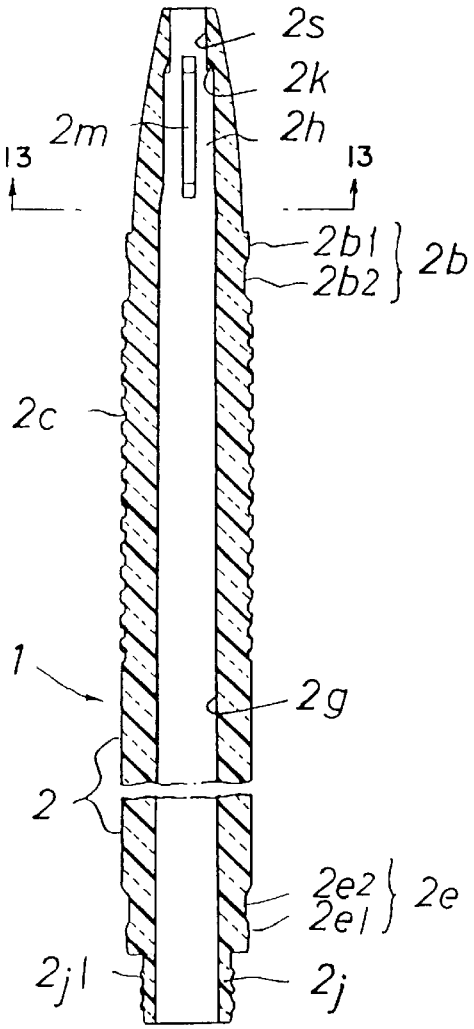
FIG. 12 is an enlarged longitudinal section of a main portion of the writing device of FIG. 10.
Figure 13:
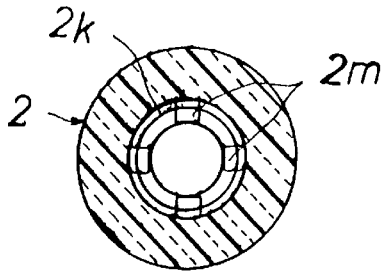
FIG. 13 is a cross-section along the line D—D of FIG. 12.

When the writing device according to the first embodiment is carried, as shown in FIG. 9, it is attached to a pocket 12 of clothing in the state that the cap 7 is fitted to the writing device body 1. The outside cloth 12*a* of the pocket 12 is elastically held between the clip 11 of the cap 7 and the cap body 8 and the axial pipe 2 of the writing device body 1.

In the aforesaid state of being attached to the pocket 12, the protrusion 11*c* of the clip 11 causes the outside cloth 12*a* to curve and enter the annular indentations provided in the holding portion 2*c* of the axial pipe 2. Thus, the protrusion 11*c* engages with the axial pipe 2 via the outside cloth 12*a*.

Accordingly, even when an external force is applied to the clip 11 of the cap 7 or the like in a releasing direction, the cap 7 or the cap 7 and the writing device body 1 are less likely to come off the pocket 12.

A plurality of engaging protrusions 8*h* projecting from the inner surface of the cap body 8 engage with the annular depression 2*b*2 in the engaging portion 2*b*, which comprises the annular protrusion 2*b*1 formed on the outer surface of the head end portion of the writing device body 2 and the annular depression 2*b*2 formed integrally with the annular protrusion 2*b*1 on the tail end side thereof. Thus, even when an external force is applied to the cap 7 in such an axial direction that the cap 7 comes off the head end of the writing device body 1, the cap 7 is less likely to unintentionally come off the writing device body 1 because it is necessary for the engaging protrusions 8*h* to overcome a resistance to their moving over the annular protrusion 2*b*1.

By holding the cap body 8 in a hand and pulling it up from the outside cloth 12*a* of the pocket 12, the cap 7, together with the writing device body 1, is pulled out of the pocket 12. By holding the cap 7 in one hand and the writing device body 1 in the other hand and pulling the cap 7 from the writing device body 1, the cap 7 is removed from the writing device body 1. A user holds the axial pipe 2 at the holding portion 2*c* and writes on paper or the like using the pencil lead 6 provided in the head endmost writing cartridge 4 of the pencil lead member.

Also, the cap 7 which has been removed from the writing device body 1 is fitted to the tail end portion of the axial pipe 2, whereby the engaging protrusions 8*h* of the cap 7 click-engaged with the annular depression 2*e*2 of the engaging portion 2*e* at the tail end side of the axial pipe 2. Thus, the loss of the cap 7 can be prevented.

During writing, a writing force is transmitted from the pencil lead 6 of the head endmost writing cartridge 4 to the adjacent writing cartridges 4 through their holding cylinders 5. The holding cylinder 5 of the second tail endmost cartridge 4 is received at the head end of the tapered cylindrical body 3*d* of the tail plug 3. As a result, a force is applied to the tapered cylindrical body 3*d* for expansion, whereby the head end portion of the tapered cylindrical body 3*d* is pressed against the inner surface of the large-bore portion 2*i* provided at the tail end portion of the axial pipe 2 of the writing device body 1. Accordingly, the tail plug 3 is held in the axial pipe 2 without displacement toward the tail end side. That is, the head endmost cartridge 4 does not retreat due to the writing force.

The writing force is hardly applied from the second tail endmost writing cartridge 4 to the tail endmost writing cartridge 4 which is fitted and held in the cylindrical portion 3*a* of the tail plug 3. Accordingly, the tail endmost writing cartridge 4 is not pushed out from the tail end of the tail plug 3.

Further, during writing or drawing characters, figures and the like, the holding portion 2*c* of the axial pipe 2 is held in fingers. Since a number of annular indentations and protrusions are alternately and continuously arranged at the holding portion 2*c* in the axial direction, the holding fingers are less likely to slip on the holding portion 2*c*, thereby facilitating hold on the holding portion 2*c*.

When the pencil lead 6 of the head endmost writing cartridge 4 becomes unusable due to wear or breakage, the head endmost writing cartridge 4 is held in a hand at the head portion of the holding cylinder 5 and pulled out of the head end of the axial pipe 2. The holding cylinder 5 of the removed writing cartridge 4 is inserted into the holding cylinder 5 of the tail endmost writing cartridge 4 from the head end side thereof. This causes the writing cartridges 4 to advance, thereby rendering the formerly second head endmost writing cartridge 4 the head endmost writing cartridge 4. Thus, the user can write with the pencil lead 6 of the new head endmost writing cartridge 4.

Subsequently, by repeating the operation described above, a large number of characters and the like can be written using all writing cartridges 4 loaded in the axial pipe 3. When all the writing cartridges 4 become unusable, new writing cartridges 4 can be loaded into the axial pipe 2 to replace the unusable writing cartridges 4.

When the eraser 9 is to be used, the end cover 10 is removed from the projecting cylinder 8*d* provided on the cap body 8 of the cap 7. When the use is completed, the end cover 10 is fitted to the projecting cylinder 8*d*.

Even when an infant or the like accidentally swallows the end cover 10 which has come off the projecting cylinder 8*d* and when the swallowed end cover 10 enters his/her trachea or gullet, the end cover 10 is readily taken out of his/her body using the ventilation hole 10*a* which is formed in the end cover 10 at the central portion of the head end thereof. Also, even when the end cover 10 is caught in the trachea, he or she can still breathe, and a doctor at a hospital can take it out of the body.

When the cap 7 removed from the axial pipe 2 of the writing device body 1 is to be fitted back to the writing device body 1, the cap 7 is held in a hand, and then the cap body 8 of the cap 7 is fitted to the head end portion of the axial pipe 2 so as to cover the head end portion of the axial pipe 2 of the writing device body 1 and the portion of the head endmost writing cartridge 4 projecting beyond the head end of the axial pipe 2. When the engaging protrusions 8*h* provided on the inner surface of the cap body 8 move over the annular protrusion 2*b*1 of the engaging portion 2*b* formed on the outer surface of the axial pipe 2, the cap body 8 elastically deforms. Then, when the engaging protrusions 8*h* engage with the annular depression 2*b*2, the cap body 8 is restored to complete the engagement. A click occurs upon the engagement so that the user can make sure that the engaging protrusions 8*h* have properly engaged with the annular depression 2*b*2 of the engaging portion 2*b*.

The axial pipe 2 of the writing device body 1 is transparent, and the inner surface of the axially intermediate portion of the axial pipe 2 has the polygonal portion 2*g* having a cross-sectional shape of a regular hexagon, for example. The corresponding outer surface of the axial pipe 2 has a circular cross-section. This provides a lens function with a resultant attractive appearance.

A writing device according to a second embodiment of the present invention comprises a ballpoint pen. As shown in FIGS. 10 to 13, a writing device body 1 has an axial pipe 2 and a tail plug 3.

In the axial pipe 2, a small-outside diameter portion 2*j* is formed on the outer surface of the tail end portion thereof. Four anchoring annular protrusions 2*j*1 are formed on the small-outside diameter portion 2*j* and arranged at a predetermined spacing in the axial direction of the axial pipe 2. A small-bore portion 2*h* having a circular cross-section is extended from the head end of the polygonal portion 2*g* of the inner surface. The head end portion of the small-bore portion 2*h* is further reduced in a bore diameter via a shoulder 2*k* to form a metallic cylinder fitting portion 2*s*. Four axially extending protrusions 2*m* are formed equally spaced in the circumferential direction on the portion of the small-bore portion 2*h* extending toward the tail end from the shoulder 2*k*.

Figure 14:
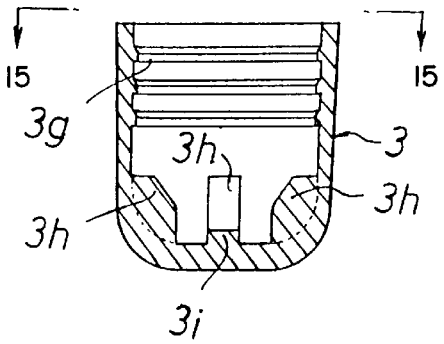
FIG. 14 is a longitudinal section showing the tail plug of the writing device according to the second embodiment.
Figure 15:
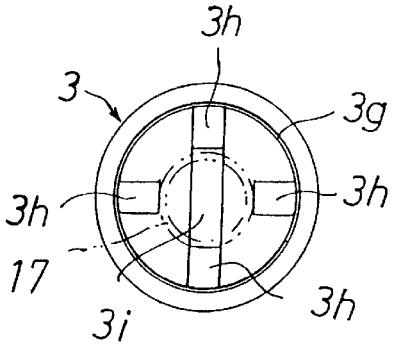
FIG. 15 is a view from the line E—E of FIG. 14 showing the tail plug.

As shown in FIGS. 14 and 15, in a tail plug 3, a bottom is formed at the tail end of a cylindrical portion, and a plurality of engaging annular protrusions 3*g* are formed on an inner surface arranged at a predetermined spacing in the axial direction. Four protrusions 3*h* are formed at the portion of the inner surface located between the engaging annular protrusions 3*g* and the bottom. A supporting protrusion 3*i* is formed on the bottom portion at the center. The tail plug 3 is integrally formed of slightly elastic, opaquely colored plastic.

The structure of the axial pipe 2 and the tail plug 3 other than that described above is similar to that of the axial pipe and the tail plug according to the first embodiment. Thus, in FIGS. 10 to 16, corresponding portions are denoted by the same reference numerals as in FIGS. 1 to 8, and their description is herein omitted.

A ballpoint pen core 14 which composes a core member is a conventional one. A ball 15 is rotatably fitted into the head end portion of a metallic cylinder 16, and the base portion of the metallic cylinder 16 is securely fitted into the head end portion of a transparent or semitransparent plastic tube 17. Oil ink 18 is contained in the plastic tube 17 and the metallic cylinder 16.

The ballpoint pen core 14 is inserted into the axial pipe 2 from outside the tail end thereof so that the ball 17 is positioned at the head end side thereof. The head end of the plastic tube 17 of the ballpoint pen core 14 is supported by the shoulder 2*k* of the small-bore portion 2*h* provided at the head end portion of the axial pipe 2. The portion of the metallic cylinder 16 projecting from the plastic tube 17 is inserted into the metallic cylinder fitting portion 2*s* of the small-bore portion 2*h* leaving almost no clearance therebetween. The head end portion of the metallic cylinder 16, together with the ball 15, is projected from the head end of the axial pipe 2. The outer surface of the head end portion of the plastic tube 17 is supported by the protrusions 2*m* formed on the small-bore portion 2*h*.

In the state described above, the tail plug 3 is press-fitted into the small-outside diameter portion 2*j* formed at the tail end portion of the axial pipe 2. The engaging annular protrusions 3*g* formed on the inner surface of the tail plug 3 are engaged with the anchoring annular protrusions 2*j*1 provided on the small-outside diameter portion 2*j*, thereby holding the tail plug 3 on the axial pipe 2. The tail end of the plastic tube 17 is supported by the supporting protrusion 3*i* of the tail plug 3. Also, the outer surface of the tail end portion of the plastic tube 17 is supported by the protrusions 3*h* formed on the inner surface of the tail plug 3.

A cap 7 has a similar structure to the cap according to the first embodiment except that the eraser is not provided and that the end cover 10 is opaquely colored in the same color as that of the tail plug 3. Thus, in FIGS. 10 to 13, corresponding portions are denoted by the same reference numerals as in FIGS. 1 to 5, and their description is herein omitted.

The use of the aforesaid writing device comprising the ballpoint pen according to the first embodiment will now be described.

When the writing device according to the second embodiment with the cap 7 fitted to the writing device body 1 is carried attached to the pocket portion of clothing, the cap 7 is less likely to come off the pocket portion and to unwillingly come off the writing device body 1, as in the aforesaid writing device according to the first embodiment.

The cap 7, together with the writing device body 1, is pulled out of the pocket. The cap 7 is removed from the writing device body 1. The engaging protrusions 8*h* of the cap 7 engage with the engaging portion 2*e* of the tail end portion of the axial pipe 2, thereby holding the cap 7 on the tail end portion. The user writes on paper or the like by means of the ball 15 provided in the ballpoint pen core 14 and the oil ink 18 contained in the metallic cylinder 16 and the tube 17.

During writing, a writing force is received by the supporting protrusion 3*i* of the tail plug 3 via the metallic cylinder 16 and tube 17 of the ballpoint pen core 14. The engaging annular protrusions 3*g* of the tail plug 3 are engaged with the anchoring annular protrusions 2*j*1 provided on the small-outside diameter portion 2*j* located on the outer surface of the tail end portion of the axial pipe 2. Accordingly, the tail plug 3 is held on the axial pipe 2 without displacement toward the tail end side. That is, the ballpoint pen core 14 does not retreat due to the writing force.

The metallic cylinder 16 of the ballpoint pen core 14 inserted into the metallic cylinder fitting portion 2*s* is provided at the head end portion of the axial pipe 2 leaving almost no clearance therebetween. Also, the head end portion of the outer surface of the plastic tube 17 is supported by the four protrusions 2*m* provided on the inner surface of the small-bore portion 2*h* provided at the head end portion of the axial pipe 2, and the tail end portion of the outer surface of the plastic tube 17 is supported by the four protrusions 3*h* provided on the inner surface of the tail plug 3. Accordingly, during writing or the like, the ballpoint pen core 14 and the plastic tube 17 do not move in radial directions. Also, since the head and tail ends of the plastic tube 17 are supported by the shoulder 2*k* located at the small-bore portion 2*h* of the axial pipe 2 and by the supporting protrusion 3*i* of the tail plug 3, respectively, the plastic tube 17 and the ballpoint pen core 14 do not move in the axial direction of the axial pipe 2.

Also, as in the writing device according to the first embodiment, since a number of annular indentations and protrusions are alternately and continuously arranged at the holding portion 2*c* of the axial pipe 2 in the axial direction, the holding fingers are less likely to slip on the holding portion 2*c*. Further, when the cap body 8 of the cap 7 removed from the axial pipe 2 is fitted to the head or tail end portion of the axial pipe 2 during using or not using the writing device body 1, the engaging protrusions 8*h* provided on the inner surface of the cap body 8 move over the annular protrusion 2*b*1 of the engaging portion 2*b* or the annular protrusion 2*e*1 of the engaging portion 2*e* and then click engaged with the annular depression 2*b*2 or 2*e*2, whereby the user can make sure that the cap 7 has properly engaged with the writing device body 1. And further, the cap 7 is less likely to unwillingly come off the writing device body 1.

The axial pipe 2 of the writing device body 1 is transparent, and the inner surface of the axially intermediate portion of the axial pipe 2 is formed into the polygonal portion 2*g*. The corresponding outer surface of the axial pipe 2 has a circular cross-section. This provides a lens function with a resultant attractive appearance. Further, the remaining amount of the oil ink 18 contained in the plastic tube 17 of the ballpoint pen core 14 can be seen from outside the axial pipe 2.

The cap for the writing device according to the second embodiment is the same as the cap according to the first embodiment except that the cap of the second embodiment is not provided with the eraser. Thus, the cap can be used in common between the writing devices according to the first and second embodiments, whereby the cost of the cap can be reduced. Preferably, in the cap according to the second embodiment, the end cover is bonded to the projecting cylinder of the cap body.

Also, the writing device according to the second embodiment may be adapted to allow the empty ballpoint pen core to be replaced with a new one by removing the tail plug. Preferably, after the replacement, the tail plug is bonded again to the small-outside diameter portion formed at the tail end portion of the axial pipe.

Preferably, three to six engaging protrusions are formed on the inner surface of the cap equally spaced in the circumferential direction, and their cross-section is shaped in an axially elongated ellipse.

The polygonal portion formed in the axial pipe of the writing device is preferably of a regular quadrangle through a regular octagon, most preferably of a regular hexagon. In the axial pipe according to the second embodiment, the polygonal portion may extend to the tail end thereof.

In the cap according to the first embodiment, even when the end cover is rendered transparent, including of colored transparency, or semitransparent, if the eraser is opaquely colored, the same attractiveness as of an opaquely colored end cover is obtained. When the end cover and the tail plug are opaquely colored in the same color or similar colors, a good color balance is obtained. This practice is suited for the writing device according to the second embodiment, i.e. ballpoint pen, and may be applied to the first embodiment.

The writing devices according to the present invention are not limited to refillable pencils and ballpoint pens, and the present invention encompasses other similar writing devices.

What is claimed is:

1. A writing device comprising a writing device axial pipe, a core member which is supported by said writing device axial pipe and which has a head end writing portion projecting from a head end portion of said writing device axial pipe, a tail plug fitted to a tail end portion of said writing device axial pipe and a cap which is removably fitted to an outer surface of said writing device axial pipe to cover the head end writing portion of said core member, wherein an engaging portion is formed on an outer surface of each of the head end portion and the tail end portion of said writing device axial pipe, each engaging portion comprising an annular protrusion and an annular depression which merges into the annular protrusion, wherein a plurality of engaging protrusions are formed on an inner surface of said cap, said engaging protrusions being arranged at a predetermined spacing in a circumferential direction, whereby said engaging protrusions engage with said annular depression upon attachment of said cap to said writing device axial pipe, the outer surface of said writing device axial pipe having a circular cross-section over an entire length thereof and an inner surface of at least an axially intermediate portion of said writing device axial pipe having a polygonal cross section, the annular protrusion in the tail end portion of the writing device axial pipe being disposed adjacent said tail plug.

2. A writing device according to claim 1, wherein said polygonal cross section is a hexagonal cross section.

3. A writing device according to claim 1, wherein said cap has at least a semitransparent cap body and an end cover fitted to the head end portion of said cap body and wherein at least one of either said tail plug or said end cover is opaquely colored.

4. A writing device according to claim 1, wherein said cap has a cap body and an end cover fitted to a projecting cylinder provided at the head end portion of said cap body and wherein a ventilation hole is formed in the central portion of said end cover to axially penetrate the central portion.

5. A writing device according to claim 1, wherein said writing device body is a refillable pencil.

6. A writing device according to claim 5, wherein said tail plug is made of an elastic plastic in which a cylindrical portion of said tail plug has a larger-outside diameter flange formed at the tail end of the cylindrical portion and a tapered cylindrical body formed at the head end of the cylindrical portion and in which a plurality of axially extending slits are provided in the tapered cylindrical body such that the slits reach the head end surface of the tapered cylindrical body, the tapered cylindrical body and the cylindrical portion are fitted into said axial pipe thereby to have the flange butt against the tail end of said axial pipe, a core member comprises a number of writing cartridges, each having a holding cylinder, a base portion of a pencil lead being securely fitted into a smaller-diameter portion of the holding cylinder, which projects from the head end portion of the larger-diameter portion of the holding cylinder, the smaller-diameter portion of the holding cylinder of a writing cartridge and the tip of the pencil lead projecting from the smaller-diameter portion are loosely inserted into the larger-diameter portion of the holding cylinder of the adjacently preceding writing cartridge of the core member, a number of the writing cartridges are fitted to one another and loaded in said axial pipe in a manner allowing axial movement, the larger-diameter portion of the holding cylinder of the head endmost writing cartridge is removably held in the head end portion of said axial pipe, and the larger-diameter portion of the holding cylinder of the tail endmost writing cartridge is fitted and held in said tail plug while the tail end of the larger-diameter portion of the holding cylinder of the second tail endmost writing cartridge butts against the head end of said tail plug.

* * * * *